United States Patent [19]

Peek

[11] 4,390,814

[45] Jun. 28, 1983

[54] LIGHTING APPARATUS

[75] Inventor: Sanford C. Peek, Andover, Mass.

[73] Assignee: GTE Laboratories Incorporated, Waltham, Mass.

[21] Appl. No.: 261,391

[22] Filed: May 7, 1981

[51] Int. Cl.[3] ..... H05B 37/02

[52] U.S. Cl. ..... 315/320; 307/38; 315/183; 315/315; 315/362

[58] Field of Search ..... 315/182, 183, 201, 250, 315/288, 294, 315, 320, 321, 324, 362; 307/38; 361/189

[56] References Cited

U.S. PATENT DOCUMENTS 3,405,315 10/1968 Moreland ..... 315/320 X
3,408,537 10/1968 Wiley ..... 315/320 X

FOREIGN PATENT DOCUMENTS 2444134 3/1976 Fed. Rep. of Germany ..... 315/320

*Primary Examiner*—Eugene R. LaRoche
*Attorney, Agent, or Firm*—David M. Keay

[57] ABSTRACT

Lighting apparatus for independently controlling the lighting level in several areas or zones. For example, each zone has two fluorescent lamp units, one connected between the power lines through the contacts of a first low voltage AC latching relay, and the other which produces about half the light of the first connected between the power lines through the contacts of a second relay. Each relay has three terminals. When a low voltage AC signal is applied between a first terminal and a common terminal, the relay is latched closed; and when a low voltage AC signal is applied between a second terminal and a common terminal the relay is latched open. The common terminals of the two relays of each zone are connected together to provide enable connections identifying each zone. The first terminals of all the first relays are connected together, the first terminals of all the second relays are connected together, the second terminals of all the first relays are connected together and the second terminals of all the second relays are connected together to provide four data connections. By applying momentary low voltage AC signals between appropriate data and enable connections, any desired combination of lamps can be turned on or off.

9 Claims, 2 Drawing Figures

LIGHTING APPARATUS

BACKGROUND OF THE INVENTION

This invention relates to electrical lighting apparatus. More particularly, it is concerned with apparatus for selectively controlling the lighting level in several zones from a remote location.

A large percentage of all electric power generated is used for commercial lighting. Most of this lighting employs fluorescent lamps. Recently there has been development effort toward conserving some of this energy through more efficient lamps and ballasts and also through the design of control systems which dim or turn off lamps when they are not needed. Dimming ballasts for fluorescent lamps are expensive and their complicated design often leads to poor reliability. Furthermore, dimming ballasts for fluorescent lamps tend to be inefficient at other than certain current levels, and lamp life is often reduced when a lamp is operated at currents other than at its rated value. Control systems are becoming less expensive as improved ones are developed. However, their installation costs particularly in an existing installation are still a major deterrent to their general acceptance.

SUMMARY OF THE INVENTION

Improved lighting apparatus in accordance with the present invention for controlling the lighting level in a multiplicity of lighting zones comprises a plurality of lamp units located at each of the zones. A set of switching means is located at each of the zones and each set has switching means corresponding to those of every other set. Each lamp unit is connected to a source of electrical power for operating the lamp unit through a switching means located at the associated zone. Each switching means has a first, a second, and a common terminal. A switching means is latched in a closed circuit condition in response to simultaneous signals at the first and common terminals, and is latched in an open circuit condition in response to simultaneous signals at the second and common terminals. The common terminals of the switching means within each set are connected together thus providing a multiplicity of enable connections, one for each zone. The first terminals of the corresponding switching means from each set are connected together providing a group of ON connections, the number of ON connections being equal to the number of switching means in each set. The second terminals of the corresponding switching means of each set are also connected together providing a group of OFF connections, the number of OFF connections also being equal to the number of switching means in each set. The apparatus also includes control means for selectively applying a signal to selected connections of the groups of ON and OFF connections and for selectively applying a signal simultaneously to selected enable connections whereby predetermined lamp units are selectively turned on or off.

For a better understanding of the present invention, together with other and further objects, advantages, and capabilities thereof, reference is made to the following discussion and appended claims in connection with the above-described drawing.

DETAILED DESCRIPTION OF THE INVENTION

Figure 1:
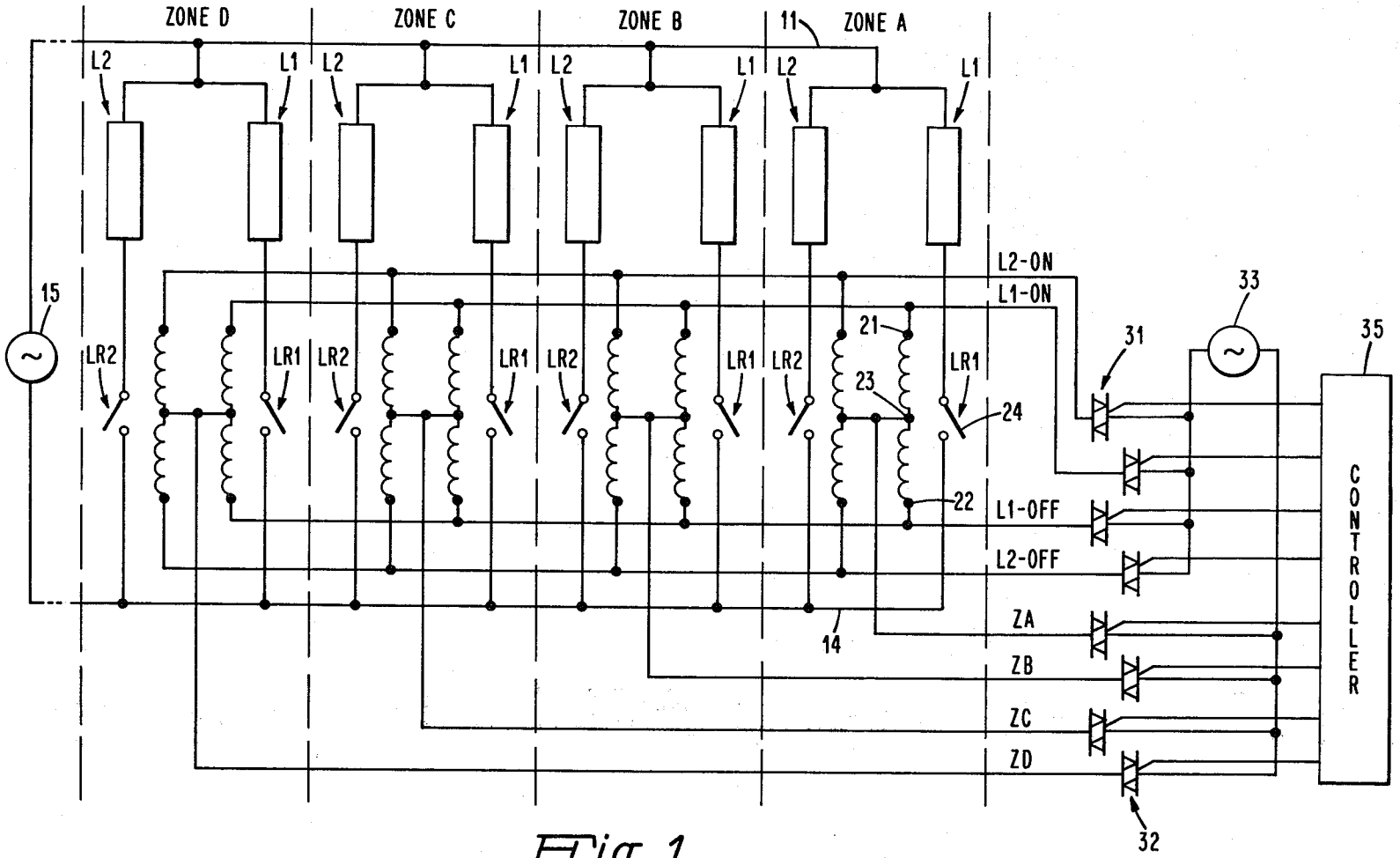
FIG. 1 is a schematic diagram of an exemplary lighting apparatus in accordance with the present invention.

An exemplary apparatus in accordance with the present invention as illustrated in FIG. 1 includes two fluorescent lamp units L1 and L2 located at each of four locations labeled zone A through zone D. In one embodiment the light intensity of one lamp unit L1 is approximately twice that of the other lamp unit L2. In each zone the lamp units L1 and L2 are controlled independently by latching relays LR1 and LR2, respectively, as will be explained in detail hereinbelow.

For purposes of illustration the arrangement of components as shown in each zone A–D is the same. In zone A, for example, the lamp units L1 and L2 are connected directly to one conductor 11 and through the latching relays LR1 and LR2, respectively, to another conductor 14. The two conductors 11 and 14 provide AC operating potential, for example 120 volts, as from a source indicated by 15. As shown, the lamp units in each zone are all connected in common to the conductors 11 and 14, although this is not necessarily the case and one or more lamp units may have independent sources of operating power. The lamp units L1 and L2 as shown schematically include one or more fluorescent lamps and ballasts.

The latching relay LR1 is a standard conventional latching relay having a first terminal 21, a second terminal 22, and a common terminal 23. When a momentary current passes through the coil between the first and common terminals 21 and 23, the contacts 24 are latched in a closed condition. When a momentary current is passed through the coil between the second and common terminals 22 and 23, the contacts 24 are latched in the open condition. All the latching relays within the illustrated apparatus are identical and operate in the same manner to open and close contacts in response to which coil is momentarily activated by low voltage signals, typically 24 volts AC, between the common terminal and one of the other two terminals.

The common terminals 23 of the two relays LR1 and LR2 of the set within each zone are connected together and to conductors to form enable lines ZA, ZB, ZC, and ZD which uniquely identify zones A, B, C, and D, respectively. All of the first terminals 21 of the first relays LR1 of each set are connected together to a data line labeled L1-ON. All of the second terminals 22 of the relays LR1 of each set are connected together to a data line labeled L1-OFF. In a similar manner the first terminals 21 of the second relays LR2 of each set are connected together to a data line L2-ON and all the second terminals 22 of the second relays are connected to a data line L2-OFF.

Each of the data lines L1-ON, L2-ON, L1-OFF, and L2-OFF is connected through a gate-controlled semiconductor switching device 31 to one terminal of a suitable low voltage source, for example a 24 volt AC source 33. The enable lines ZA, ZB, ZC, and ZD are connected through gate-controlled semiconductor switching devices 32 to the other terminal of the low voltage source 33. The gate or control electrodes of each of the switching devices 31 and 32 is connected to a controller 35.

Activation of any one of the switching devices 31 simultaneously with any one of the switching devices 32 by the controller 35 closes a current loop for the source 33 through one of the coils of one of the latching relays LR1, LR2 of the set at one of the zones A–D causing one lamp unit L1 or the other lamp unit L2 to be turned on or off. Thus, by momentarily turning on one or more of the switching devices 31 and one or more of the switching devices 32 any desired combination of lighting of lamp unit L1, lamp unit L2, both or none in each of the zones A, B, C, and D can be obtained.

Figure 1A:
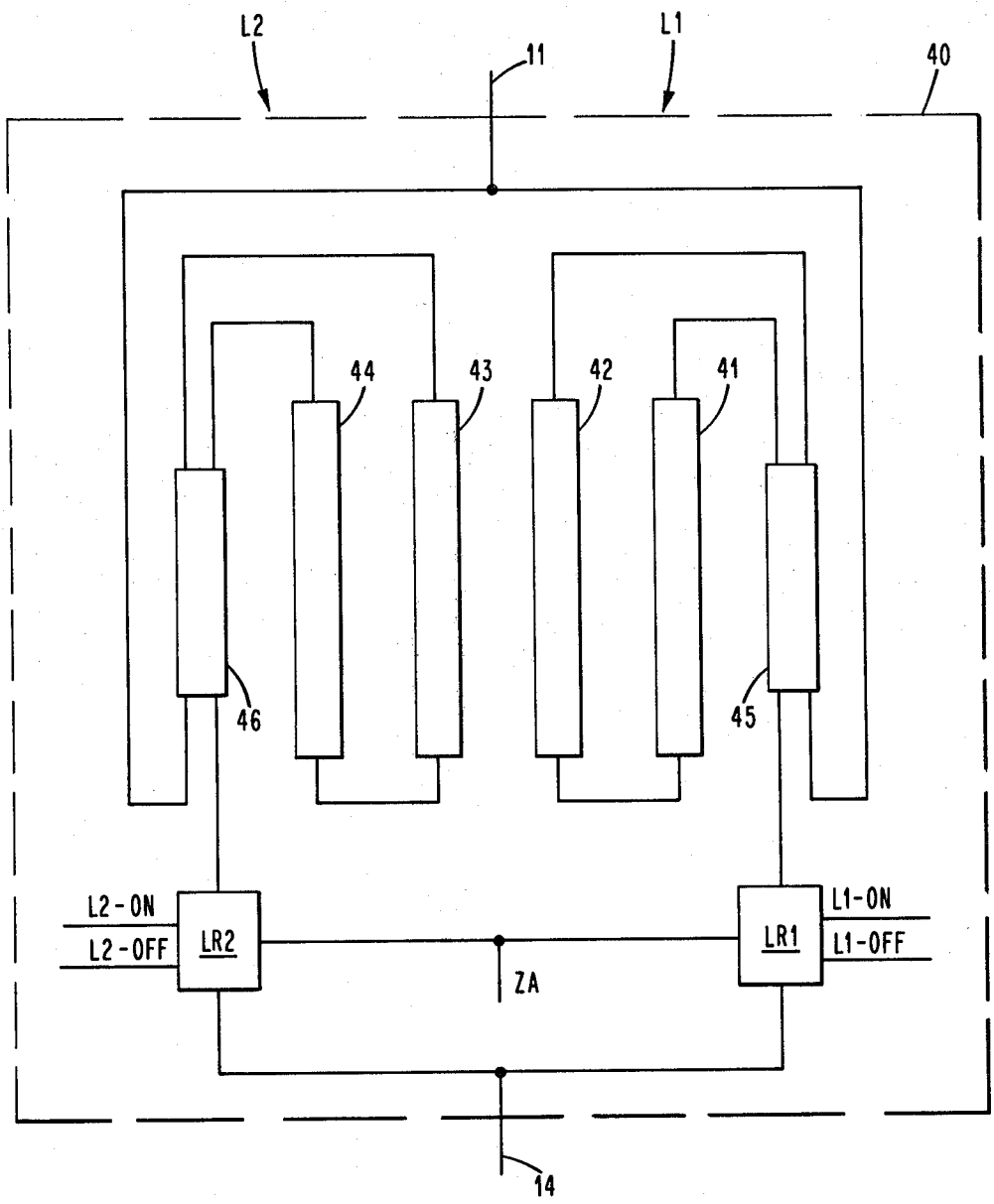
FIG. 1A is a diagram of a portion of the apparatus of FIG. 1 illustrating one specific embodiment in greater detail.

FIG. 1A illustrates a specific arrangement of lamp units L1 and L2 and latching relays LR1 and LR2 arranged in a single fixture, one or more of which may provide lighting in a zone. The fixture 40 as indicated by the dashed line may be a standard, conventional fluorescent lighting fixture of the type adapted for mounting four fluorescent lamps 41, 42, 43, and 44. Two fluorescent lamps 41 and 42 which are part of the lamp unit L1 are connected in series to one ballast 45 and two fluorescent lamps 43 and 44 which are part of the other lamp unit L2 are connected in series to another ballast 46. One ballast 45 is connected to one AC line 11 and through latching relay LR1 to the other AC line 14. The other ballast 46 is connected to one AC line 11 and through latching relay LR2 to the other AC line 14. The two ballasts 45 and 46 are identical and the four fluorescent lamps are of the same size.

In order for the light output of the fixture 40 to be variable in approximately equal increments the one lamp unit L1 includes two standard 40 watt fluorescent lamps 41 and 42 for which the fixture was designed. The other lamp unit L2 includes one standard 40 watt fluorescent lamp 43 and a commercially-available fluorescent lamp 44 which operates to reduce the current flowing through the two lamps 43 and 44 in series. The resulting combination of lamps 43 and 44 is equivalent to about 45 watts. Thus, the light intensity of lamp unit L2 can be considered as approximately half that of lamp unit L1. Depending upon the size of the area to be lighted two or more similar arrangements as illustrated in FIG. 1A may be provided in a zone with their corresponding electrical connections connected in parallel.

As is apparent from FIG. 1A existing lighting systems employing standard four-lamp fixtures readily can be modified to provide a system in accordance with the present invention. A reduced current lamp is substituted for one of the 40 watt lamps in the fixture. Two latching relays are provided which may be mounted within or closely adjacent to the fixture. One line from each ballast is connected to an AC line through a latching relay. No other high voltage connections or additional wiring is required. All additional wiring between the fixture and the controller is low voltage wiring.

In an alternative arrangement to that illustrated by FIG. 1A, lamp unit L2 includes a single fluorescent lamp and an associated ballast and lamp unit L1 includes two fluorescent lamps, each the same as that in lamp unit L2, and an associated ballast. The three lamps and associated ballasts may be mounted in a single three-lamp fixture.

The controller 35 may be any of various arrangements from a set of eight manually operated switches and a suitable voltage source to a microprocessor based system. For certain situations the controller 35 may include a timing device in order to vary the light levels with the time of day or week. Alternatively, appropriate light levels can be selected as determined by monitoring the light level, number of persons, or other parameters within each zone under the control of a microprocessor system. The system thus permits of a great deal of flexibility.

Lighting apparatus as illustrated employs a control system which operates at low voltage as compared with the operating voltage of the lamps themselves. In adding the control system to existing installations, no electronics or high voltage components are required at the lamps or in the zones being controlled. Only low voltage wiring and low voltage relays are required to be added in the zones remote from the central control system. The relays readily may be mounted within or adjacent to the light fixtures. Thus, addition of the lighting control system to existing installations or modifications of the system after it is installed is relatively simple and inexpensive.

While there has been shown and described what is considered a preferred embodiment of the present invention, it will be obvious to those skilled in the art that various changes and modifications may be made therein without departing from the invention as defined by the appended claims.

What is claimed is:

1. Lighting apparatus for controlling the lighting level in a multiplicity of lighting zones comprising a plurality of lamp units located at each of said zones;

a set of switching means located at each of said zones, each set having switching means corresponding to those of every other set;

each lamp unit being connected to a source of electrical power for operating the lamp unit through a switching means at the associated zone;

each switching means having first, second, and common terminals; said switching means being operable to be latched in a closed circuit condition in response to simultaneous signals at the first and common terminals, and being operable to be latched in an open circuit condition in response to simultaneous signals at the second and common terminals;

the common terminals of the switching means within each set being connected together providing a multiplicity of enable connections;

the first terminals of the corresponding switching means from each set being connected together providing a group of ON connections;

the second terminals of the corresponding switching means from each set being connected together providing a group of OFF connections; and control means for selectively applying a signal to selected connections of said groups of ON and OFF connections and for selectively applying a signal simultaneously to selected enable connections whereby predetermined lamp units are selectively turned on or off.

2. Lighting apparatus in accordance with claim 1 wherein each of said switching means includes a latching type relay,

3. Lighting apparatus in accordance with claim 2 wherein each lamp unit operates at a relatively high voltage;

each latching type relay operates at a relatively low voltage; and said control means applies signals at relatively low voltage to said latching type relays.

4. Lighting apparatus in accordance with claim 3 wherein said lamp units include fluorescent lamps.

5. Lighting apparatus in accordance with claim 4 wherein each of the switching means of a set is connected to lamp units of different light intensity.

6. Lighting apparatus in accordance with claim 4 wherein two lamp units are located at each of said zones;

two latching type relays are located at each of said zones; and one of said lamp units is connected to one of the latching type relays and the other of said lamp units is connected to the other of the latching type relays.

7. Lighting apparatus in accordance with claim 6 wherein said one of said two lamp units located at each of said zones has a higher light intensity than said other lamp unit.

8. Lighting apparatus in accordance with claim 7 wherein said one of said two lamp units located at each of said zones has a light intensity approximately twice that of said other lamp unit.

9. Lighting apparatus in accordance with claim 6 wherein said two lamp units are mounted in a single lighting fixture;

said one of said lamp units includes two fluorescent lamps connected in series and a ballast connected thereto;

said other of said lamp units includes two fluorescent lamps connected in series and a ballast connected thereto;

each of said fluorescent lamps is of the same size, and said ballasts are substantially identical; and one of the fluorescent lamps of said other of said lamp units operates to reduce current flow therethrough causing the light intensity of the other of said lamp units to be less that of the one of said lamp units.

* * * * *